United States Patent [19]

Rodriguez

[11] 4,337,938

[45] Jul. 6, 1982

[54] JOGGER'S AID

[76] Inventor: Basilides Rodriguez, 33 Berkley Rd., Mantua, N.J. 08051

[21] Appl. No.: 241,151

[22] Filed: Mar. 6, 1981

[51] Int. Cl.[3] ..... A63B 23/00; A63B 69/00

[52] U.S. Cl. ..... 272/93; 272/143; 272/DIG. 5; 272/70; 224/258; 224/901; 128/94

[58] Field of Search ..... 272/125, 126, 137, 70, 272/DIG. 5, 96, 93, 143; 224/202, 201, 218, 204, 257, 258, 260; 128/94, 133; 2/323

[56] References Cited

U.S. PATENT DOCUMENTS

| | | | |
|---|---|---|---|
| 1,487,281 | 3/1924 | Solleder | 224/602 |
| 1,894,888 | 1/1933 | Ponton | 2/323 |
| 2,616,419 | 11/1952 | Karfiol | 128/94 |
| 2,935,066 | 5/1960 | Holloway | 128/94 |
| 3,267,490 | 8/1966 | Wallace | 2/323 |
| 4,033,580 | 7/1977 | Paris | 272/137 |
| 4,212,458 | 7/1980 | Bizilia | 272/93 |

*Primary Examiner*—George J. Marlo
*Attorney, Agent, or Firm*—Duffield & Lehrer

[57] ABSTRACT

A jogger or runner's aid increases the endurance of a runner by supporting the weight of his arms as he runs. The device includes a shoulder strap which fits around the back of the user's neck. A pair of end straps are pivotally secured to the ends of the shoulder strap by rings and include hand loops and thumb loops at their ends for supporting the wearer's arms. The length of the straps may be adjustable to accommodate different people. An optional pedometer or other type of distance measuring device may be secured to one of the end straps.

8 Claims, 3 Drawing Figures

JOGGER'S AID

BACKGROUND OF THE INVENTION

The present invention is directed toward a jogger or runner's aid and more particularly toward a device which increases the endurances of a runner by supporting the weight of his arms as he runs.

People have long recognized the necessity of a regular physical fitness or exercise program for good general health and fitness. While jogging and running have always been known to be excellent forms of excercise, they were not, until recently, popular activities. However, during the past several years jogging has become extremely popular and is engaged in on a regular basis by large numbers of men and women both old and young.

Unfortunately, many joggers become very tired or exhausted long before they feel that they have had sufficient excercise. A similar problem has apparently been experienced by long distance runners. That is, they may become very tired although they feel that they have sufficient strength left in their legs to continue running.

Applicant believes that it is the weight of a jogger's or runner's arms which causes the person to become prematurely tired. It is believed that eliminating or reducing this weight as one is running will substantially decrease the rate at which a jogger or runner tires.

SUMMARY OF THE INVENTION

The present invention is designed to overcome the problem described above. The jogger or runner's aid of the invention increases the endurance of a runner by supporting the weight of his arms as he runs. The device includes a shoulder strap which fits around the back of the user's neck. A pair of end straps are pivotally secured to the ends of the shoulder strap by rings and include hand loops and thumb loops at their ends for supporting the wearer's arms. The length of the straps may be adjustable to accommodate different people. An optional pedometer or other type of distance measuring device may be secured to one of the end straps.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
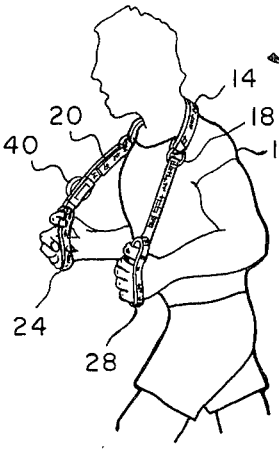
FIG. 1 is a perspective view of the jogger's aid constructed in accordance with the principles of the present invention and being shown in use by a jogger.
Figure 2:
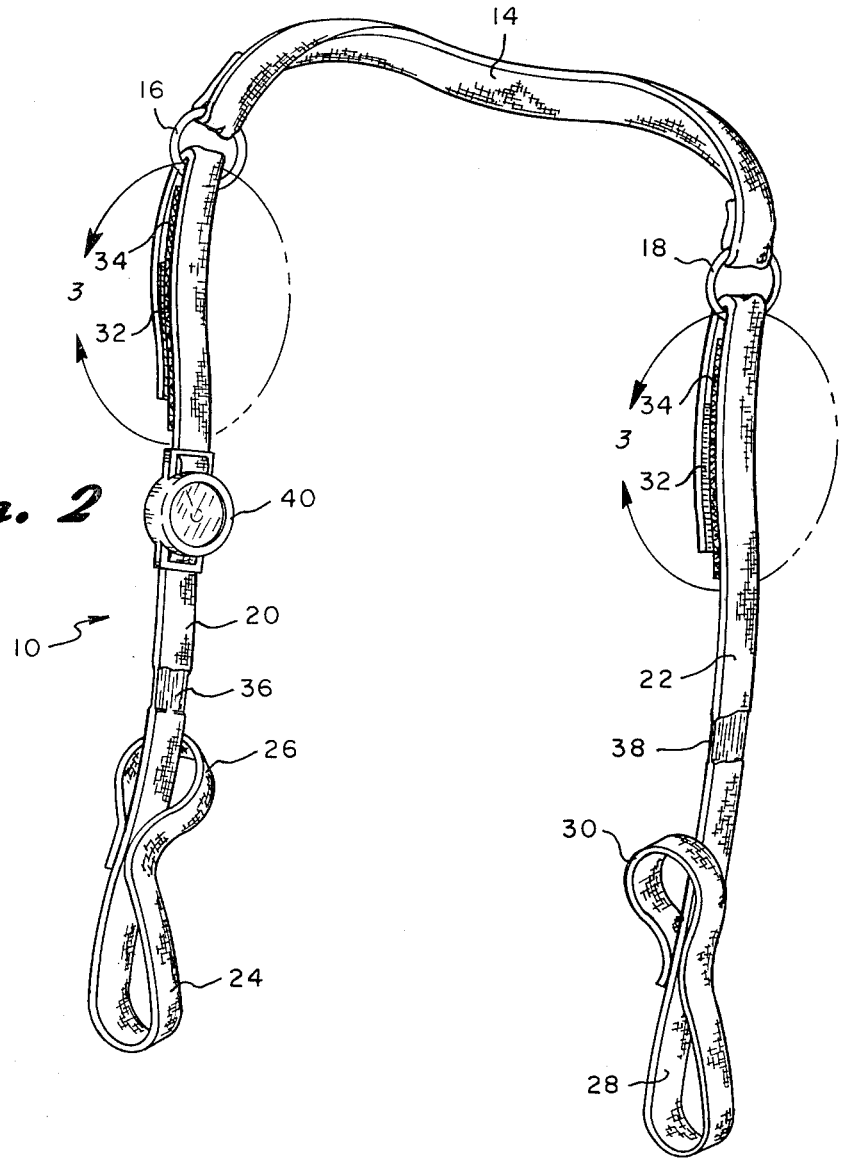
FIG. 2 is a perspective view of the invention illustrating some of the details thereof.

Referring now to the drawings in detail wherein like reference numerals have been used throughout the various figures to designate like elements, there is shown in FIGS. 1 and 2 a jogger's aid constructed in accordance with the principles of the present invention and designated generally as 10.

FIG. 2 illustrates the device itself and FIG. 1 shows the same being utilized by a jogger 12.

The jogger's aid 10 is comprised essentially of an elongated strap-like device including an intermediate section or shoulder strap 14. Loosely secured to the ends of the shoulder strap 14 are metal rings 16 and 18. A pair of end straps 20 and 22 are likewise loosely secured to the rings 16 and 18, respectively.

The free end of end section or strap 20 includes a lower loop 24 and an upper loop 26. Substantially identical loops 28 and 30, respectively, are formed on the free end of the end strap 22. Lower loops 24 and 28 are large enough to encircle and support the four fingers and, preferably, part of the palm of a person's hand. The upper loops 26 and 30 are of a size and are arranged so as to encircle and support the thumb of the person's hand which is supported in the lower loops. The manner in which the loops 24-30 support a runner's hands is clearly illustrated in FIG. 1.

As is shown in FIG. 2, the loops 26–30 are preferably made simply by folding over and sewing or otherwise secufing the ends of the straps 20 and 22. It is within the scope of the invention, however, to manufacture the loops separately from the same or a different material and to then secure the loops to the ends of the straps 20 and 22 using any known fastening means.

As shown most clearly in FIG. 1, the jogger's aid 10 is worn by placing the shoulder strap portion 14 around the back of the jogger's neck. His hands are inserted into the loops 24 and 28 with the thumbs inserted into the loops 26 and 30. The length of the jogger's aid 10 should be such that the jogger's forearms are substantially horizontal as shown in FIG. 1. That is, the overall length of the jogger's aid 10 should be such that it extends approximately from the runner's waist up one side of his chest, around the back of his neck and down the other side of his chest to his waist again, substantially as shown in FIG. 1.

So that the jogger's aid 10 can be utilized by different size people, the overall length thereof is adjustable. In the preferred embodiment, the adjustment is made by adjusting the lengths of the end straps 20 and 22. This is preferably accomplished by the use of Velcro fasteners.

Figure 3:
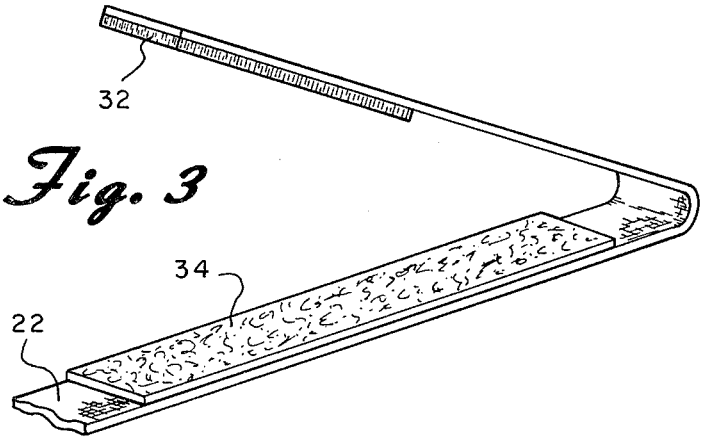
FIG. 3 is a detailed view of the portion of FIG. 2 shown at section 3—3.

Referring to FIG. 3, it can be seen that the upper end of each of the end straps 20 and 22 has a pad of Velcro hooks 32 sewn or otherwise secured to the inner face of the extreme end thereof. An elongated pad of Velcro pile material 34 is also sewn or otherwise secured to the inner face of the straps 20 and 22 at a position which is several inches away from the pad 32. In use, the end of the strap 20 or 22 is inserted through the ring 16 or 18 and is then bent downwardly so that the hooks 32 engage the pile material 34 so as to become securely fastened thereto. By selectively attaching the hooks 32 to the desired portion of the pile material 34, the length of each of the straps 20 and 22 can be adjusted. That is, in order to shorten the straps, the hooks 32 are secured to the lowermost portion of the pile material 34. Conversely, to lengthen the straps, the hooks 32 may be secured to the uppermost portion of the pile material 34.

All of the straps 14, 20 and 22 of the jogger's aid 10 are preferably made from a substantially flexible fabric material. In some cases, it may also be desirable to make the entire device or the end straps 20 and 22 from a slightly elastic material. Alternatively, elastic portions 36 and 38 may be sewn into the end straps 20 and 22, respectively. The elastic portions 36 and 38 or the elasticity of the straps themselves will function as shock absorbers to absorb the shock of the movement of the arms when the jogger is running. This will, of course, have the effect of relieving some of the force or pressure on the jogger's neck.

It is well known that when a jogger is running, his arms naturally move in a back and forth motion. Although the jogger's aid 10 of the present invention supports the weight of the jogger's arms, they will still be free to move back and forth and thus the end straps 20 and 22 will also move back and forth as the jogger is running. It should be noted that the shoulder strap 14 and the end straps 20 and 22 are relatively loosely secured to the rings 16 and 18 so as to allow the straps 20 and 22 to move freely back and forth. Because of the movement of the straps 20 and 22, a pedometer or similar distance measuring device 40 can be mounted on end strap 20 or 22. The pedometer 40 will measure the running distance in substantially the same manner as if it were conventionally mounted adjacent the runner's foot.

The present invention may be embodied in other specific forms without departing from the spirit or essential attributes thereof and accordingly, reference should be made to the appended claims rather than to the foregoing specification as indicating the scope of the invention.

I claim:

1. A devie for increasing the endurance of a runner by supporting the weight of his arms comprising:

an elongated strap, said strap being of a length so as to extend approximately from a runner's waist, up one side of his chest, around the back of his neck and down the other side of his chest to his waist again, and upper and lower loops formed at each free end of said strap, each of said lower loops being large enough to encircle and support the four fingers of one of the runner's hands, each of said upper loops being of sufficient size and being located relative to the lower loop to encircle and support the thumb of the hand being supported in the respective lower loop.

2. The device as claimed in claim 1 further including means for adjusting the length of said strap.

3. The device as claimed in claim 1 wherein said strap is comprised of a pair of end sections and an intermediate section, each of said end sections being connected to a different end of said intermediate section by a ring.

4. The device as claimed in claim 3 wherein each of said end sections is adjustable in length.

5. The device as claimed in claim 4 wherein the length of each of said end sections is adjusted by a Velcro fastening means.

6. The device as claimed in claim 1 wherein at least part of said strap is comprised of an elastic material.

7. The device as claimed in claim 1 including a distance measuring means mounted on said strap.

8. The device as claimed in claim 7 wherein said distance measuring means is a pedometer.

* * * * *